US006952536B2

(12) United States Patent
Soar et al.

(10) Patent No.: US 6,952,536 B2
(45) Date of Patent: Oct. 4, 2005

(54) TRANSMISSIVE OPTICAL SENSING OF LEADING EDGES OF MEDIA SHEETS ADVANCED SUBSTANTIALLY ADJACENT TO ONE ANOTHER

(75) Inventors: Steven Soar, Vancouver, WA (US); Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 171 days.

(21) Appl. No.: 10/679,079

(22) Filed: Oct. 4, 2003

(65) Prior Publication Data

US 2005/0074247 A1 Apr. 7, 2005

(51) Int. Cl.[7] ..... G03G 15/00

(52) U.S. Cl. ..... 399/16; 399/371; 271/3.13; 271/10.01; 400/708

(58) Field of Search ..... 399/9, 16, 361, 399/367, 368, 371, 372, 68; 400/578, 586, 400/605, 708; 226/10, 45; 270/58.01–58.04; 271/3.12–3.13, 264, 265.01, 10.01–10.03, 271/121, 242, 259

(56) References Cited

U.S. PATENT DOCUMENTS

| | | | | |
|---|---|---|---|---|
| 5,482,265 | A * | 1/1996 | Nakazato et al. | 271/242 |
| 6,076,821 | A * | 6/2000 | Embry et al. | 271/10.01 |
| 6,079,892 | A * | 6/2000 | Yamaguchi et al. | 400/708 |
| 6,154,621 | A * | 11/2000 | Yamamoto et al. | 399/68 |
| 6,231,041 | B1 * | 5/2001 | Jacques | 271/121 |
| 6,554,275 | B1 * | 4/2003 | Tranquilla | 271/259 |
| 2002/0044813 | A1 | 4/2002 | Barbera et al. | |

* cited by examiner

*Primary Examiner*—Minh Chau

(57) ABSTRACT

A method of an embodiment of the invention is disclosed that advances media sheets through an image-forming device such that each successive pair of media sheets are advanced at least substantially adjacent to one another. The method transmissively optically senses a leading edge of each of the media sheets and a lagging edge of each of the media sheets. The method detects occurrence of an out-of-media sheets situation where a length of time after the lagging edge of one of the media sheets has been optically sensed exceeds a threshold length of time.

20 Claims, 9 Drawing Sheets

TRANSMISSIVE OPTICAL SENSING OF LEADING EDGES OF MEDIA SHEETS ADVANCED SUBSTANTIALLY ADJACENT TO ONE ANOTHER

BACKGROUND

Inkjet printers have become popular for printing on media, especially when precise printing of color images is needed. For instance, such printers have become popular for printing color image files generated using digital cameras, for printing color copies of business presentations, and so on. An inkjet printer is more generically an image-forming device that forms images onto media, such as paper. Other types of image-forming devices include laser printers and photocopying machines.

To determine when a new sheet of media is being advanced through an image-forming device, the device may include a mechanical flag that is pushed out of the way by the sheet as it advances past the flag. Other types of devices, such as industrial paper handlers, also employ such mechanical flags. For consecutive sheets of media, a sufficiently large gap between the sheets is needed so that there is enough time for the flag to fall back to its default position and thus be able to detect the second sheet advancing through the device, after advancement of the first sheet through the device. However, delaying advancement of the second sheet of media through the image-forming device to allow for the gap reduces maximum printing speed, and thus printing performance of the device.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Transmissive Optical Sensor Assembly

Figure 1:
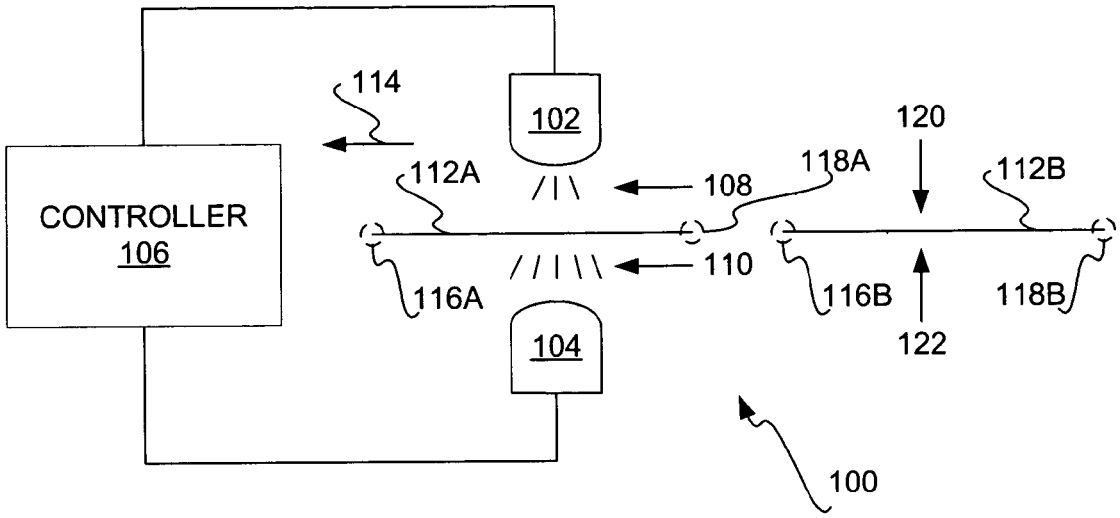
FIG. 1 is a diagram of a transmissive optical sensor assembly for an image-forming device, according to an embodiment of the invention.

FIG. 1 shows a transmissive optical sensor assembly 100 for an image-forming device, according to an embodiment of the invention. The optical sensor assembly 100 includes a light source 102, a transmissive optical sensor 104, and a controller 106. Media sheets 112A and 112B, collectively referred to as the media sheets 112, are advanced between the light source 102 and the transmissive optical sensor 104, in the direction 114. The media sheets 112 may be paper, or another type of media. The media sheets 112A and 112B have leading edges 116A and 116B, which are collectively referred to as the leading edges 116, and which are the first edges of the media sheets 112 that pass between the light source 102 and the optical sensor 104. The media sheets 112A and 112B further have lagging edges 118A and 118B, which are collectively referred to as the lagging edges 118, and which are the last edges of the media sheets 112 that pass between the light source 102 and the optical sensor 104.

The light source 102 may include one or more light-emitting diodes (LED's), or other types of light sources. The light source 102 emits light 108 incident to a first side 120 of the media sheets 112, some of which is transmitted through the media sheets 112 as the media sheets 112 advance between the light source 102 and the optical sensor 104. The portion of the light 108 that is transmitted through the media sheets 112 is identified as the transmitted light 110. When none of the media sheets 112 is currently between the light source 102 and the transmissive optical sensor 104, then the transmitted light 110 includes substantially all of the emitted light 108. Where one or more of the media sheets 112 is currently between the light source 102 and the optical sensor 104, then the transmitted light 110 includes the portion of the emitted light 108 that is transmitted through these one or more sheets, as opposed to that portion of the emitted light 108 that is reflected off the media sheets, for instance.

The transmissive optical sensor 104 may include one or more phototransistors, or other types of optical sensors. The optical sensor 104 detects, or senses, the transmitted light 110 from the second side 122 of the media sheets 112 opposite to the first side 120 thereof. As such, the optical sensor 104 is a transmissive optical sensor. In other words, the optical sensor 104 detects the portion of the light 108 emitted by the light source 102 that is transmitted through the media sheets 112 as the transmitted light 110. The optical sensor 104 thus is able to detect changes in the transmitted light 110 as the media sheets 112 pass between the light source 102 and the optical sensor 104. The optical sensor 104 provides a sensor signal corresponding to the level of the transmitted light 110.

The controller 106 may include hardware, software, or a combination of hardware and software. The controller 106 is able to control, such as turn on and off, and vary the intensity of, the light source 102. Controlling intensity is used to set the output signal at a midrange value with a sheet of media placed in the sensor gap. The controller 106 is also able to receive sensor signals from the transmissive optical sensor 104 corresponding to the transmitted light 110 detected by the sensor 104. Based on the transmitted light 110 detected by the sensor 104, the controller 106 is able to determine the locations of the leading and lagging edges of each of the media sheets 112, by determining when the leading edges 116 and the lagging edges 118 of the media sheets 112 pass between the light source 102 and the optical sensor 104, based on changes in the light 110 detected by the sensor 104. This is described in more detail in subsequent sections of the detailed description. The controller 106 may also detect, or determine, occurrences of out-of-media sheets and multiple-media sheet pick-up situations, based on changes in the light 110 detected by the sensor 104, as is also described in more detail in subsequent sections of the detailed description.

Advancement of Adjacent Media Sheets Resulting in Small Gap Therebetween

Figure 2:
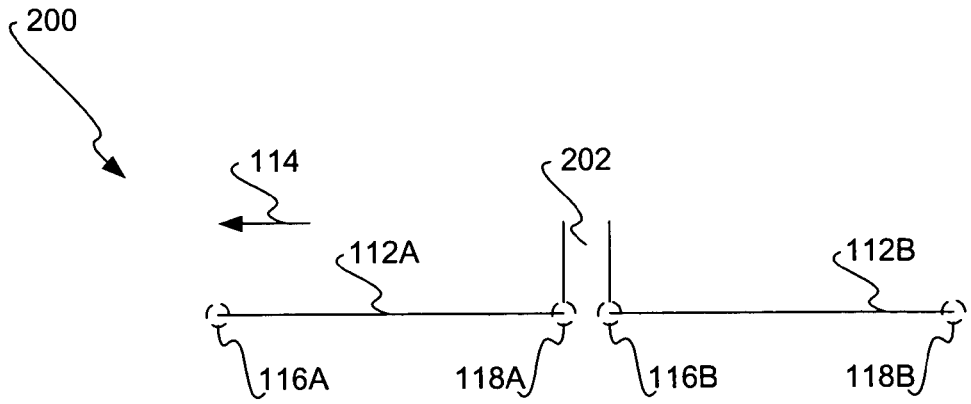
FIG. 2 is a diagram showing how the lagging edge of a first sheet of media and the leading edge of a second sheet of media can define a small gap therebetween when being consecutively or successively advanced through an image-forming device, according to an embodiment of the invention.

FIG. 2 shows a situation 200 in which the media sheets 112 are advanced in the direction 114 such that a small gap 202 is defined between the lagging edge 118A of the media sheet 112A and the leading edge 116B of the media sheet 112B, according to an embodiment of the invention. The sensor assembly 100 of FIG. 1 and its constituent components are not shown in FIG. 2 for illustrative clarity. In general, the media sheets 112 are advanced such that they are substantially adjacent to one another, or closely following one another. However, in practice, in some cases the media sheets 112 may in actuality be advanced such that the small gap 202 is defined therebetween.

The small gap 202 may thus be defined as the gap that can result when attempting to advance the media sheets 112 substantially adjacent to one another, such that the leading edge 116B of the media sheet 112B is advanced substantially adjacent to, or closely follows, the lagging edge 118A of the media sheet 112A. The small gap 202 may further be defined as much less than the gap that is needed for a mechanical flag to be used to detect the leading edge 116B of the media 112B, as described in the background section of the detailed description. The media sheets 112 constitute a successive pair of media sheets that may be advanced in the direction 114.

Figure 3:
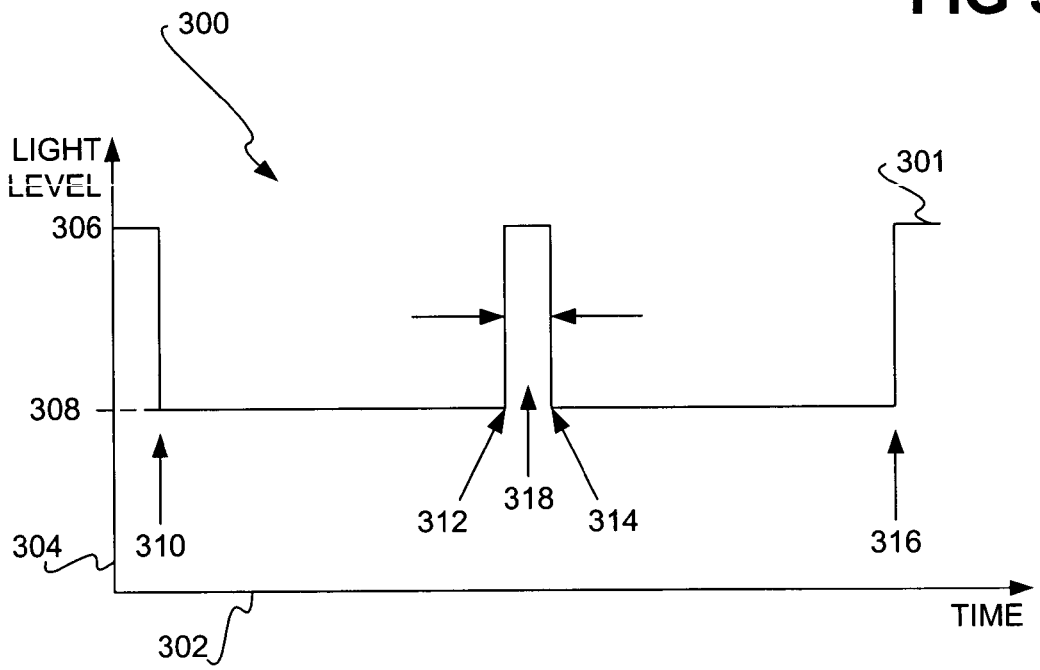
FIG. 3 is a graph showing the transmissive optical sensor signal that results in the media advancement situation of FIG. 2, such that the leading edge of the second sheet of media is able to be detected, according to an embodiment of the invention.

FIG. 3 shows a graph 300 of the sensor signal 301 resulting from the transmissive optical sensor 104 detecting the light 110 transmitted through the media sheets 112, as emitted by the light source 102 as the light 108, in the situation 200 of FIG. 2, according to an embodiment of the invention. The graph 300 denotes the level of the transmitted light 110 along the y-axis 304 as a function of time along the x-axis 302. The value of the sensor signal 301 at any given point along the x-axis 302 represents the level of the transmitted light 110 detected by the optical sensor 104 at the corresponding point in time. Therefore, as the media sheets 112 advance in the direction 114 in FIG. 2, the corresponding sensor signal 301 results.

Before the leading edge 116A of the media sheet 112A in FIG. 2 passes between the light source 102 and the transmissive optical sensor 104, corresponding to the point 310 in FIG. 3, the sensor signal 301 has a typically saturated value 306. Once the leading edge 116A of the media sheet 112A passes between the light source 102 and the optical sensor 104, the sensor signal 301 drops to a value 308 less than the value 306. This is because, before the leading edge 116A of the media sheet 112A passes between the light source 102 and the optical sensor 104, nothing is in-between the light source 102 and the optical sensor 104. Therefore, the value of the transmitted light 110 is at a substantially maximum value, or the value 306. Once the leading edge 116A of the media sheet 112A passes between the light source 102 and the optical sensor 104, the media sheet 112A is between the light source 102 and the optical sensor 104, and thus the value of the transmitted light 110 decreases to a lower level, or the value 308.

After the lagging edge 118A of the media sheet 112A in FIG. 2 passes between the light source 102 and the transmissive optical sensor 104, corresponding to the point 312 in FIG. 3, the sensor signal 301 returns to the value 306 from the value 308. This is because there is again nothing in-between the light source 102 and the optical sensor 104. Once the leading edge 116B of the media sheet 112B passes between the light source 102 and the optical sensor 104, corresponding to the point 314, the sensor signal 301 again drops to the value 308. Finally, once the lagging edge 118B of the media sheet 112B passes between the light source 102 and the optical sensor 104, corresponding to the point 316, the sensor signal 301 returns to the value 306.

Therefore, the changes in the transmitted light 110 detected by the transmissive optical sensor 104 as the media sheets 112 are advanced substantially adjacent to one another are able to indicate the beginning of each of the media sheets 112. When the sensor signal 301 drops from the value 306 to the value 308, this drop in the transmitted light 110 corresponds to the leading edge of one of the media sheets 112 passing between the light source 102 and the optical sensor 104. Because the controller 106 a priori has knowledge of where the light source 102 and the optical sensor 104 are positioned, the controller 106 is thus able to determine the locations of the leading edges 116 of the media sheets 112 as the media sheets 112 are advanced.

Similarly, when the sensor signal 301 increases from the value 308 back to the value 306, this increase in the transmitted light 110 corresponds to the lagging edge of one of the media sheets 112 passing between the light source 102 and the optical sensor 104. The controller 106 is thus able to determine the locations of the lagging edges of the media sheets 112 as they are advanced. The length of time 318 between the points 312 and 314 in FIG. 3, corresponding to the gap 202 between the lagging edge 118A of the media sheet 112A and the leading edge 118B of the media sheet 112B, may also be utilized by the controller 106 to measure the gap 202 where the speed of media advancement is known.

Furthermore, determining the locations of the lagging edges of the media sheets 112 as they are advanced allows for determining the length of the media sheets as they are advanced. The time between the leading edge of one the media sheets 112 being detected and the lagging edge of this media sheet being detected, multiplied by the speed of media advancement, is the length of the media sheet. The length of the media sheet can then be compared to whether it is a regular letter-sized sheet, an A4-sized media sheet, or another type of sheet of media.

Advancement of Adjacent Media Sheets Resulting in Small Overlap Therebetween

Figure 4:
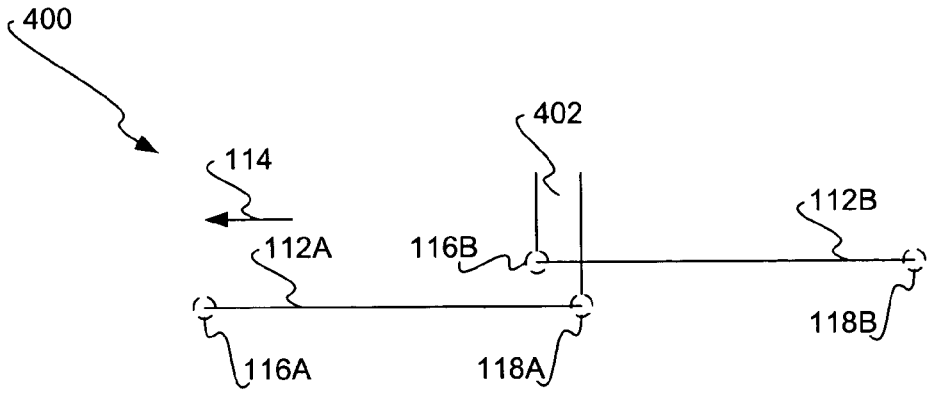
FIG. 4 is a diagram showing how the lagging edge of a first sheet of media and the leading edge of a second sheet of media can minimally overlap when being consecutively or successively advanced through an image-forming device, according to an embodiment of the invention.

FIG. 4 shows a situation 400 in which the media sheets 112 are advanced in the direction 114 such that a small overlap 402 results between the lagging edge 118A of the media sheet 112 and the leading edge 116B of the media sheet 112B, according to an embodiment of the invention. The sensor assembly 100 of FIG. 1 and its constituent components are not shown in FIG. 4 for illustrative clarity. As before, in general the media sheets 112 are advanced such that they are substantially adjacent on one another. However, in practice, in some cases the media sheets 112 may in actuality be advanced such that the small overlap 402 results. That is, successive pairs of the media sheets 112 may be advanced such that in some cases the small gap 202 results, as in the situation 200 of FIG. 2, and in other cases the small overlap 402 results. The small overlap 402 may be defined as the overlap that can result when attempting to advance the media sheets 112 substantially adjacent to one another, such that the leading edge 116B of the media sheet 112B closely overlaps the lagging edge 118A of the media sheet 112A. The small overlap may further be generally defined as being a minimal overlap, such as less than a threshold of one-eighth of an inch, or another value.

Figure 5:
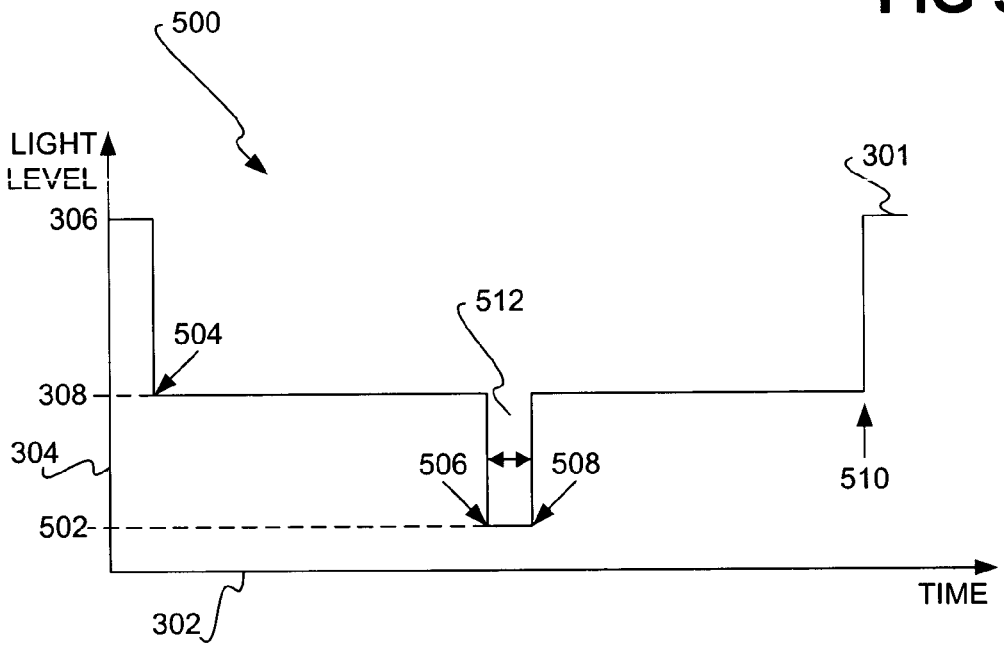
FIG. 5 is a graph showing the transmissive optical sensor signal that results in the media advancement situation of FIG. 4, such that the leading edge of the second sheet of media is able to be detected, according to an embodiment of the invention.

FIG. 5 shows a graph 500 of the sensor signal 301 resulting from the transmissive optical sensor 104 detecting the light 110 transmitted through the media sheets 112 in the situation 400 of FIG. 4, according to an embodiment of the invention. The graph 500 denotes the level of the transmitted light 110 along the y-axis 304 as a function of time along the x-axis 302, as with the graph 300 of FIG. 3. Before the leading edge 116A of the media sheet 112A in FIG. 4 passes between the light source 102 and the optical sensor 104, corresponding to the point 504 in FIG. 5, the sensor signal 301 has the value 306. Once the leading edge 116A of the media sheet 112A passes between the light source 102 and the optical sensor 104, the sensor signal 301 drops to the value 308 less than the value 306, as in FIG. 3.

However, once the leading edge 116B of the media sheet 112B also passes between the light source 102 and the transmissive optical sensor 104, corresponding to the point 506 in FIG. 5, such that both the media sheets 112A and 112B are passing between the light source 102 and the optical sensor 104, the sensor signal 301 drops again, to the value 502 less than the value 306. This is because even less of the light 108 emitted by the light source 102 is transmitted through the two media sheets 112A and 112B, as compared to that which is transmitted through just the media sheet 112A, such that the optical sensor 104 detects the transmitted light 110 having the lesser value 502.

After the lagging edge 118A of the media sheet 112A passes between the light source 102 and the transmissive optical sensor 104, corresponding to the point 508 in FIG. 5, the sensor signal 301 increases back to the value 308, because now just the media sheet 112B is between the light source 102 and the optical sensor 104. Assuming the media sheets 112A and 112B are the same type of media, the value of the sensor signal 301 between the points 504 and 506 is substantially identical to the value thereof between the points 508 and 510. Finally, once the lagging edge 118B of the media sheet 112B passes between the light source 102 and the optical sensor 104, corresponding to the point 510, the sensor signal 301 returns to the value 306.

Therefore, the changes in the transmitted light 110 detected by the transmissive optical sensor 104 as the media sheets 112 are advanced substantially adjacent to one another are able to indicate the beginning of each of the media sheets 112. When the sensor signal 301 drops from the value 308 to the value 502 at the point 506, this drop in the transmitted light 110 corresponds to the leading edge 118B of the media sheet 112B overlapping the lagging edge 118A of the media sheet 112A. Because the controller 106 a priori has knowledge of where the light source 102 and the optical sensor 104 are positioned, the controller 106 is thus able to determine the locations of the leading edges 116 and the lagging edges 118 of the media sheets 112 as the media sheets 112 are advanced.

The controller 106 may further measure the amount of the overlap 402 by measuring the length of time 512 between the points 506 and 508 in FIG. 5, which corresponds to the overlap 402, where the speed of media advancement is known. To ensure that the overlap 402 is small, such that image formation on the media sheet 112A is unaffected by the overlap of the media sheet 112B, the controller 106 may compare the amount of overlap 402 to a threshold, and conclude that the overlap 402 is permissibly small where it is less than the threshold. Image formation on the media sheet 112A is unaffected because the overlap 402 is such that the media sheet 112B overlaps the media sheet 112A past a bottom margin of the media sheet 112A, past which image formation does not occur. Otherwise, the controller 106 may conclude that the overlap 402 has resulted from an improper multi-media sheet pick-up situation, where the overlap is greater than the threshold, as is described in the next section of the detailed description.

Furthermore, as before, determining the locations of the lagging edges of the media sheets 112 as they are advanced allows for determining the length of the media sheets as they are advanced. The time between the leading edge of one the media sheets 112 being detected and the lagging edge of this media sheet being detected, multiplied by the speed of media advancement, is the length of the media sheet. The length of the media sheet can then be compared to whether it is a regular letter-sized sheet, an A4-sized media sheet, or another type of sheet of media.

Multiple-Media Sheet Pick-Up Situation

Figure 6:
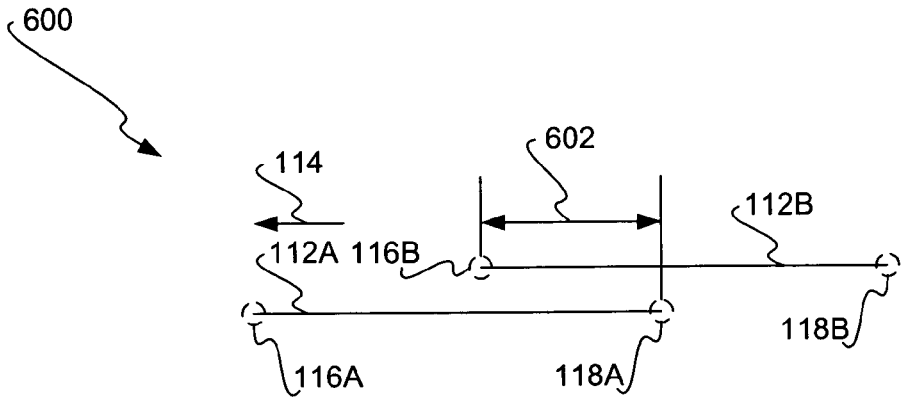
FIG. 6 is a diagram showing a multiple-media sheet pick-up situation in which two sheets of media are improperly being advanced through an image-forming device at the same time, which may occur in an embodiment of the invention.

FIG. 6 shows a multiple-media sheet pick-up situation 600 in which the media sheets 112 are advanced in the direction 114, such that the media sheet 112B improperly overlaps media sheet 112A, as may occur in an embodiment of the invention. The media sheet 112B improperly overlapping the media sheet 112A results in the overlap 602. The overlap 602 is improper in that a portion of the media sheet 112A on which image formation is desired has been overlapped by the media sheet 112B beginning at the leading edge 116B thereof.

The situation 600 is referred to as a multiple-media sheet pick-up situation because the situation 600 can occur when the image-forming device of which the sensor assembly 100 of FIG. 1 is a part mistakenly picks up both the media sheets 112 for advancement therethrough, instead of just one of the media sheets 112. That is, rather than the media sheets 112 advancing substantially adjacent to one another, such that the gap 202 of FIG. 2 or the small overlap 402 of FIG. 4 results, the media sheets 112 are substantially concurrently advanced. Two or more media sheets being advanced substantially concurrently through the image-forming device is thus referred to as a multiple-media sheet pick-up situation.

Figure 7:
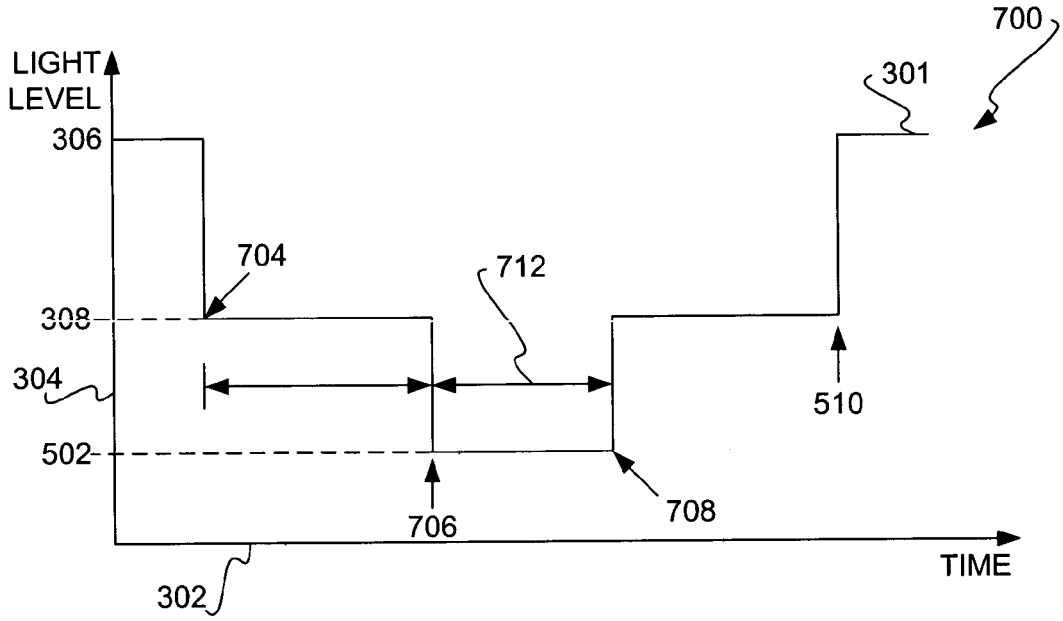
FIG. 7 is a graph showing the transmissive optical sensor signal that results in the multiple-media sheet pick-up situation of FIG. 6, such that the situation is able to be detected, according to an embodiment of the invention.

FIG. 7 shows a graph 700 of the sensor signal 301 resulting from the transmissive optical sensor 104 detecting the light 110 transmitted through the media sheets 112 in the situation 600 of FIG. 6, according to an embodiment of the invention. The graph 700 denotes the level of the transmitted light 110 along the y-axis 304 as a function of time along the x-axis 302. Before the leading edge 116A of the media sheet 112A in FIG. 6 passes between the light source 102 and the optical sensor 104, corresponding to the point 704 in FIG. 7, the sensor signal 301 has the value 306. Once the leading edge 116A of the media sheet 112A passes between the light source 102 and the optical sensor 104, the sensor signal 301 drops to the value 308 less than the value 306.

However, once the leading edge 116B of the media sheet 112B also passes between the light sensor 102 and the transmissive optical sensor 104, corresponding to the point 706 in FIG. 7, such that both the media sheets 112A and 112B are passing between the light source 102 and the optical sensor 104, the sensor signal drops again, to the value 502 less than the value 306, as in FIG. 5. After the lagging edge 118A of the media sheet 112A passes between the light source 102 and the transmissive optical sensor 104, corresponding to the point 708 in FIG. 7, the sensor signal 301 increases back to the value 308, also as in FIG. 5. Finally, once the lagging edge 118B of the media sheet 112B passes between the light source 102 and the optical sensor 104, corresponding to the point 710, the sensor signal 301 returns to the value 306.

The changes in the transmitted light 110 detected by the transmissive optical sensor 104 as the media sheets 112 are advanced substantially adjacent to one another are able to indicate the occurrence of a multiple-media sheet pick-up situation occurring. The difference between FIGS. 6 and 7 and FIGS. 4 and 5 is that in FIG. 7 the length of time 712 between the points 706 and 708 is greater than the length of time 512 between the points 506 and 508 in FIG. 5, corresponding to the overlap 602 in FIG. 6 being greater than the overlap 402 in FIG. 4. The overlaps 402 and 602 can be determined by measuring the lengths of time 512 and 712 and multiplying by the known speed of media advancement.

Comparing the overlaps 402 and 602, or the lengths of time 512 and 712, to a predetermined threshold can therefore determine whether permissible overlap has occurred or whether an undesired multiple-media sheet pick-up situation has occurred. In FIGS. 6 and 7, the overlap 602 or the length of time 712 is greater than the threshold, such that the multiple-media sheet pick-up situation 600 is detected. By comparison, in FIGS. 4 and 5, the overlap 402 or the length of time 512 is less than the threshold, such that the permissible minimal overlap situation 400 is detected. Thus, in one embodiment of the invention, comparing the length of time of overlap between two successive sheets of media, or the length of the overlap itself, to a predetermined threshold can determine whether a multiple-media sheet pick-up situation has occurred.

In another embodiment of the invention, which can be performed in addition to or in lieu of the embodiment that has just been described, the point in time 706 in FIG. 7, compared to the point in time 704, is compared against a threshold to determine whether a multiple-media sheet pick-up situation has occurred. That is, the length of time 714 between the points in time 704 and 706 is compared against a threshold to determine whether a multiple-media sheet pick-up situation has occurred. The point 704 corresponds to detection of the leading edge 116A of the media sheet 112A. If the overlap 602 starts at the point 706 too close to the leading edge 116A of the media sheet 112A having been detected, then this means that a multiple-media sheet pick-up situation has occurred. Therefore, where the length of the media sheet 112A and the speed of media advancement is known, the length of time 714 can be compared to a threshold to determine if the length of time 714 is too short for a permissible minimal overlap situation, such that a multiple-media sheet pick-up situation has occurred. That is, if the length of time 714 is less than the threshold, then the multiple-media sheet pick-up situation has occurred.

For example, in FIGS. 2 and 3, the length of time between the leading edge 116A of the media sheet 112A being detected and the lagging edge 118A thereof being detected is the length of time between the points 310 and 312. The length of time between the points 310 and 312 corresponds to the length of time for the media sheet 112A to completely advance between the light source 102 and the transmissive light sensor 104. In the minimal overlap situation 400 of FIGS. 4 and 5, the length of time between the leading edge 116A of the media sheet 112A being detected and the beginning of the overlap 402 being detected is the length of time between the points 504 and 506. The length of time between the points 504 and 506 is not substantially less than the length of time between the points 310 and 312, corresponding to the permissible minimal overlap situation 400 occurring. By comparison, in the multiple-media sheet pick-up situation 600 of FIGS. 6 and 7, the length of time between the leading edge 116A of the media sheet 112A being detected and the beginning of the overlap 602 being detected is the length of time 714. The length of time 714 is substantially less than the length of time between the points 310 and 312, corresponding to the multiple-media sheet pick-up situation 600 occurring.

Out-of-Media Sheets Situation

Figure 8:
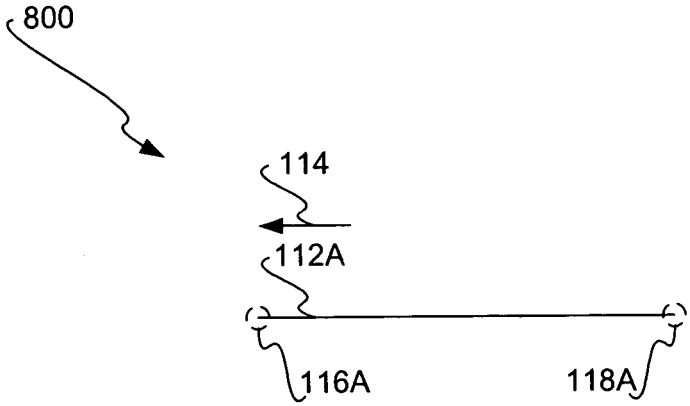
FIG. 8 is a diagram showing an out-of-media sheets situation in which the supply of media sheets for advancement through the image-forming device has been exhausted, which may occur in an embodiment of the invention.

FIG. 8 shows an out-of-media sheets situation 800 in which the media sheet 112A is advanced in the direction 114, and no further media sheets are advanced, even though they are needed for image formation thereon, as may occur in an embodiment of the invention. This may be because the media sheet 112B, not shown in FIG. 8, was not picked up as it should have been by the image-forming device, of which the sensor assembly 100 of FIG. 1 is a part, for image formation on the media sheet 112B. The situation 800 may also result where the media sheet 112A is the last sheet of media in the supply of media within the image-forming device, such that there are no more media sheets from which the device can pick up a next sheet for advancement for image formation thereon. Thus, the out-of-media sheets situation 800 can be generally defined in which no media sheets are being advanced in the direction 114 through the image-forming device, where a media sheet was expected and/or intended to be advanced in the direction 114 through the image-forming device.

Figure 9:
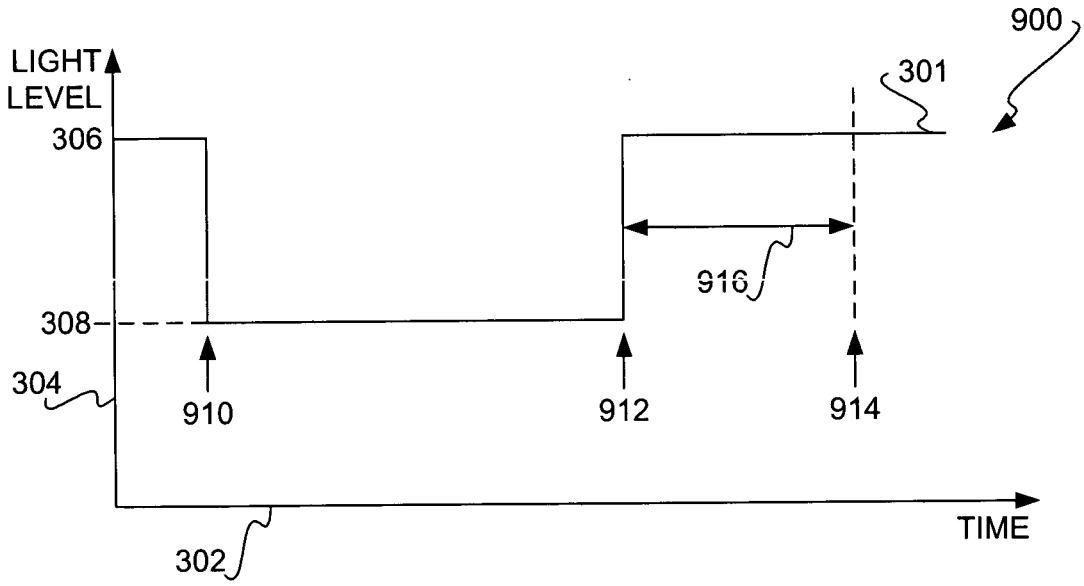
FIG. 9 is a graph showing the transmissive optical sensor signal that results in the out-of-media sheets situation of FIG. 8, such that the situation is able to be detected, according to an embodiment of the invention.

FIG. 9 shows a graph 900 of the sensor signal 301 resulting from the transmissive optical sensor 104 detecting the light 110 transmitted through the media sheets 112 in the situation 800 of FIG. 8, according to an embodiment of the invention. The graph 900 denotes the level of the transmitted light 110 along the y-axis 304 as a function of time along the x-axis 302. Before the leading edge 116A of the media sheet 112A in FIG. 6 passes between the light source 102 and the optical sensor 104, corresponding to the point 910 in FIG. 9, the sensor signal 301 has the value 306. Once the leading edge 116A of the media sheet 112A passes between the light source 102 and the optical sensor 104, the sensor signal 301 drops to the value 308. Once the lagging edge 118A of the media sheet 112A then passes between the light source 102 and the optical sensor 104, corresponding to the point 912, the sensor 301 returns to the value 306.

After the point 912, the controller 106 of FIG. 1 is expecting the transmissive optical sensor 104 to detect the leading edge of another media sheet, where this additional media sheet is needed to complete the image-formation job being performed by the image-forming device of which the sensor assembly 100 is a part. That is, the controller 106 is expecting the optical sensor 104 to detect the leading edge of another media sheet as in the minimal gap situation 200 of FIGS. 2 and 3. However, at some point 914, the length of time 916 between the point 914 and the point 912 exceeds a predetermined threshold, such that the controller 106 concludes that an additional media sheet is not being advanced, and instead that the out-of-media sheets situation 800 has occurred. That is, once the length of time 916 exceeds the threshold, the controller 106 concludes that the out-of-media sheets situation 800 has occurred. The threshold is sufficiently great so that the length of time 318 of FIG. 3, corresponding to the minimal overlap 402 between the media sheets 112A and 112B, is less than the threshold.

Transmissive Optical Sensing Method

Figure 10:
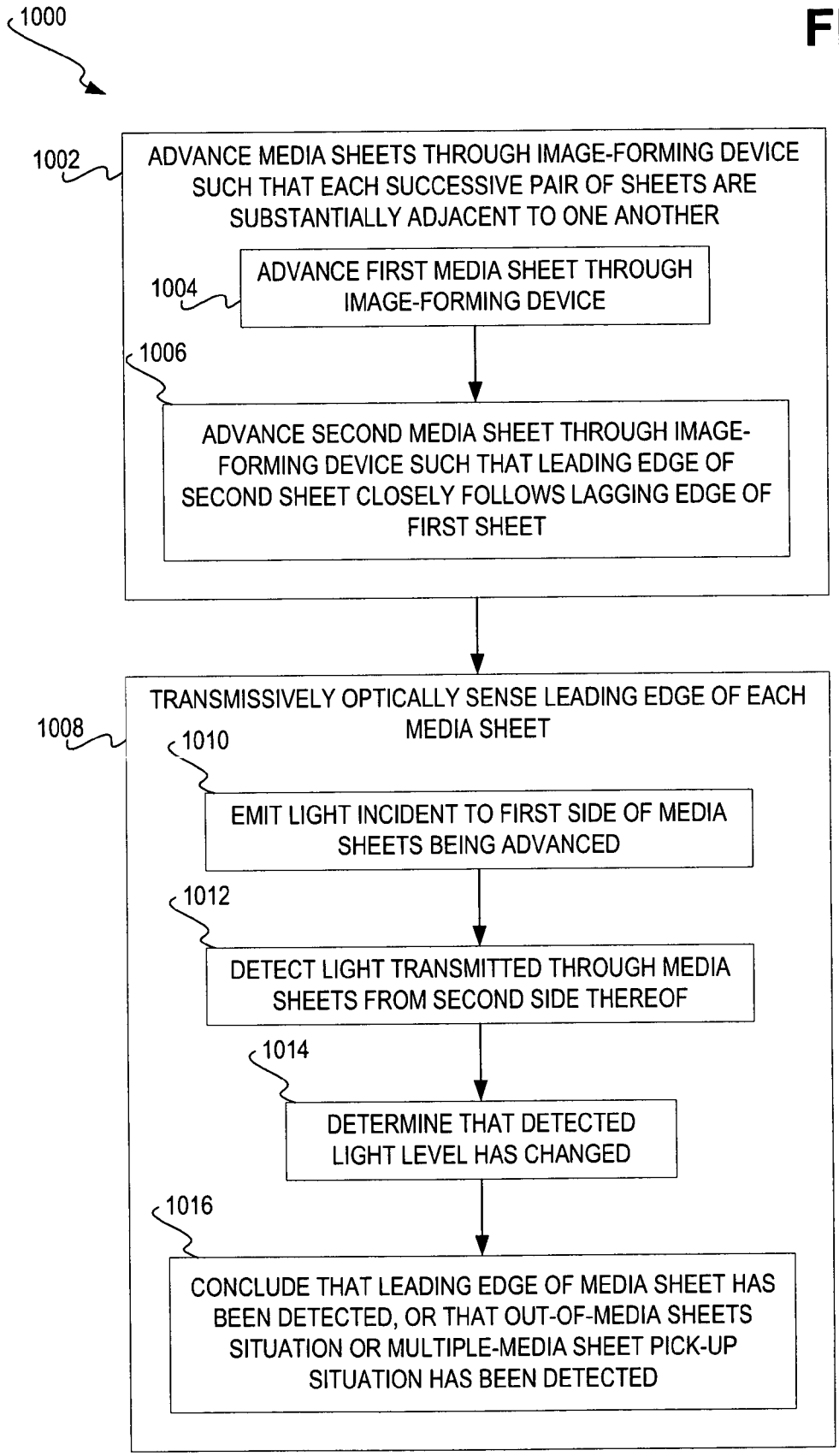
FIG. 10 is a flowchart of a method for transmissively optically sensing the leading edges of media sheets advanced substantially adjacent to one another through an image-forming device, according to an embodiment of the invention.

FIG. 10 shows a method 1000, according to an embodiment of the invention. The method 1000 is for transmissively optically sensing the leading edges 116 of the media sheets 112, the multiple-media sheet pick-up situation 600 of FIG. 6, and/or the out-of-media sheets situation 800 of FIG. 8. The method 1000 can be performed by the transmissive optical sensor assembly 100 of FIG. 1.

First, the media sheets 112 are advanced through the image-forming device of which the sensor assembly 100 is a part, such that each successive pair of sheets are substantially adjacent to one another (1002). That is, the first media sheet 112A is advanced through the image-forming device (1004), and the second media sheet 112B is advanced through the device such that the leading edge 116B of the second media sheet 112B closely follows, or is substantially adjacent to, the lagging edge 118A of the first media sheet 112A (1006). This process continues so that, for instance, a third media sheet would then be advanced through the image-forming device such that its leading edge closely follows, or is substantially adjacent to, the lagging edge 118B of the second media sheet 112B.

The first successive pair of media sheets includes the first media sheet 112A and the second media sheet 112B. They are advanced through the image-forming device such that they are substantially adjacent to one another. That is, the lagging edge 118A of the first media sheet 112A is closely followed by the leading edge 116B of the second media sheet 112B, such that the lagging edge 118A is substantially adjacent to the leading edge 116B. The second successive pair of media sheets includes the second media sheet 112B and the third media sheet described in the previous paragraph. They are advanced through the image-forming device such that they are also substantially adjacent to one another. That is, the lagging edge 118B of the second media sheet 112B is closely followed by the leading edge of the third media sheet, such that the lagging edge 118B is substantially adjacent to the leading edge of the third media sheet.

That each successive pair of media sheets are substantially adjacent to one another can in practice result in one of a number of different situations. First, the situation 200 of FIG. 2 can result, in which the first sheet of a given successive pair of media sheets and the second sheet of the pair define a small gap between the two sheets. Second, the situation 400 of FIG. 4 can result, in which the first sheet of a given successive pair slightly, or closely, overlaps a second sheet of the pair. Third, the multiple-media sheet pick-up situation 600 of FIG. 6 may result. Fourth, the out-of-media sheets situation 800 of FIG. 8 may also result.

Next, the method 1000 transmissively optically senses the leading edges 116 of the media sheets 112 (1008). The light source 102 emits the light 112 incident to the first side 120 of the media sheets 112 (1010). The light 110 transmitted through the media sheets 112 is detected by the transmissive optical sensor 104 from the second side 122 of the media sheets 112 (1014). The controller 106 determines that the detected light level has changed at some point (1016), such that it concludes that one of the situations described in the previous paragraph has occurred, or been detected (1018). That is, the controller 106 may conclude that the leading edge of a media sheet has been detected, corresponding to the situation 200 of FIG. 2 or the situation 400 of FIG. 4. Alternatively, the controller 106 may conclude that the multiple-media sheet pick-up situation 600 of FIG. 6, or the out-of-media sheets situation 800 of FIG. 8, has occurred, or been detected.

Figure 11A:
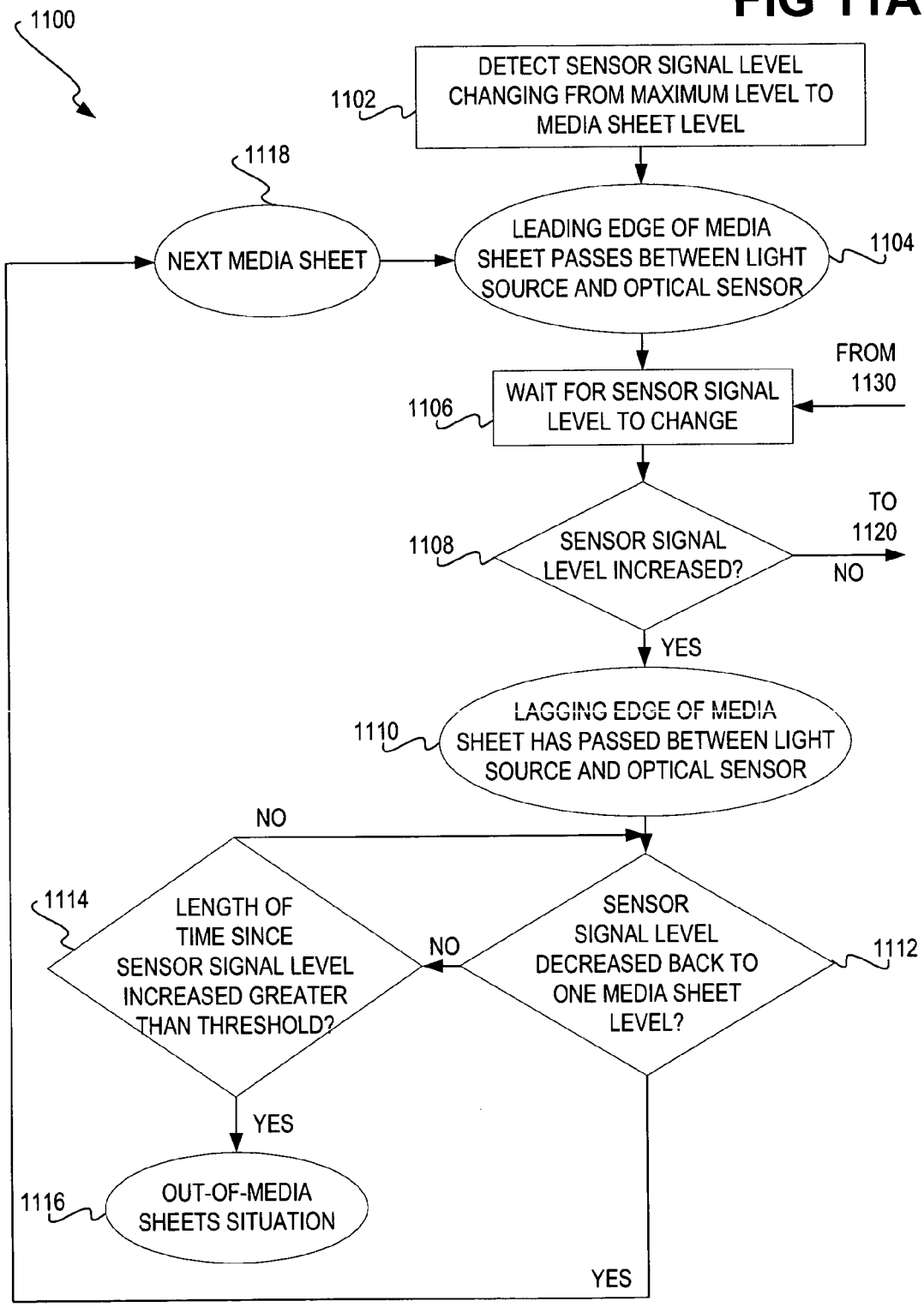
FIGS. 11A and 11B are flowcharts of a method more detailed than, but consistent with, the method of FIG. 10, according to another embodiment of the invention.
Figure 11B:
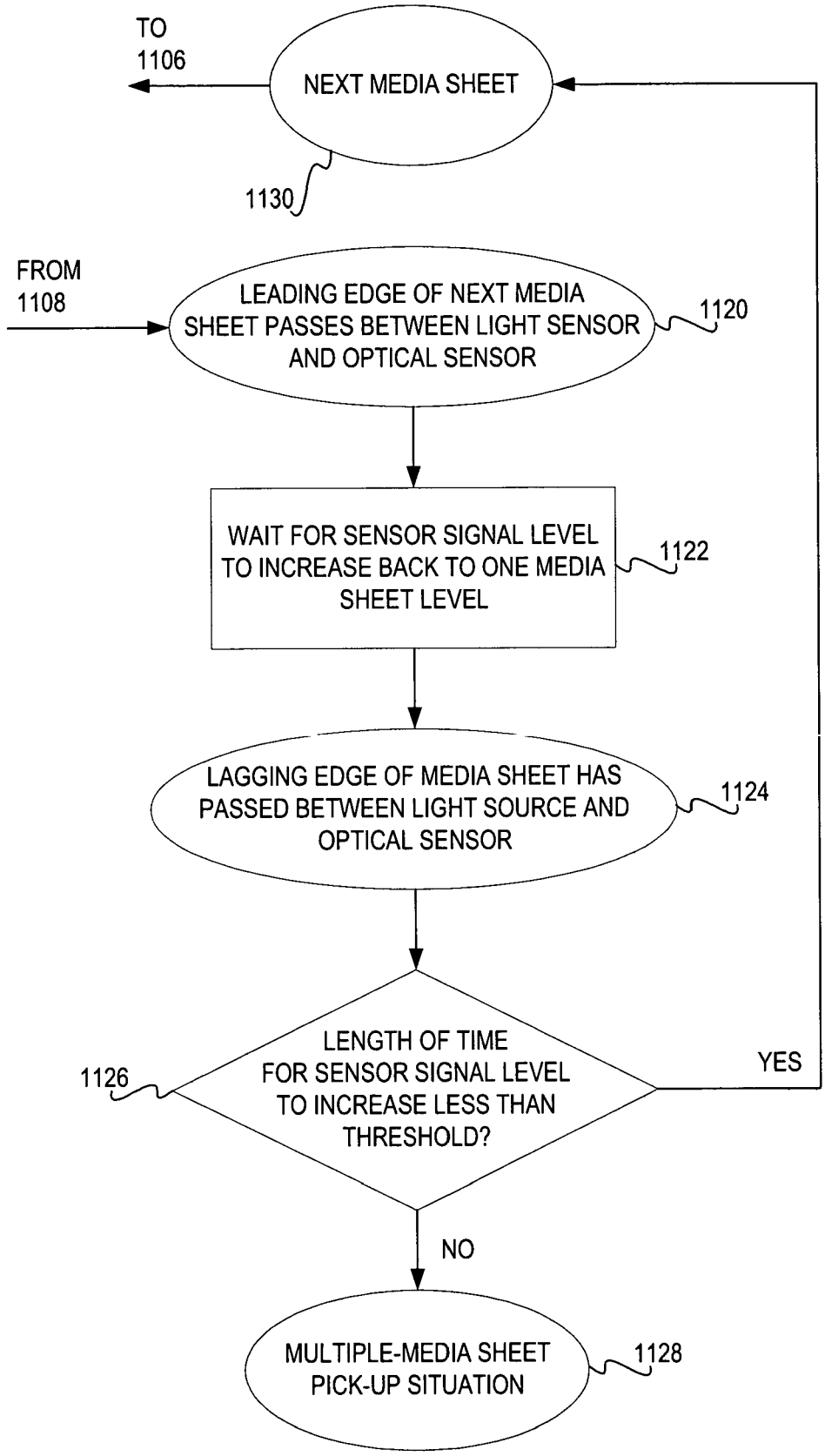

FIGS. 11A and 11B show a method 1100 that is more detailed than, but consistent, with the method 1000 of FIG. 10, according to an embodiment of the invention. The method 1100 also is for transmissively optically sensing the leading edges 116 of the media sheets 112, the multiple-media sheet pick-up situation 600 of FIG. 6, and/or the out-of-media sheets situation 800 of FIG. 8, and also can be performed by the transmissive optical sensor assembly 100 of FIG. 1. The method 1100 assumes that the light source 102 of the sensor assembly 100 is emitting the light 108, and that the transmissive optical sensor 104 of the assembly 100 is detected the transmitted light 110. The method 1100 is described in relation to the level of the signal 301 of the optical sensor 104 that has been described in conjunction with FIGS. 3, 5, 7 and 9.

First, the level of the sensor signal 301 changes from the maximum value 306 to the one media sheet value 308 (1102). This corresponds to the leading edge 116A of the media sheet 112A passing between the light source 102 and the transmissive optical sensor 104 (1104). The maximum value 306 corresponds to the level of the transmitted light 110 in which there are no media sheets between the light source 102 and the optical sensor 104. The one media sheet value 308 corresponds to the level of the transmitted light 110 in which there is one media sheet between the light source 102 and the optical sensor 104.

The method 1100 then waits for the level of the sensor signal 301 to change (1106). If the level of the signal 301 has increased (1108), such as to the maximum value 306, then the lagging edge 118A of the media sheet 112A has passed between the light source 102 and the transmissive optical sensor 104 and thus has been detected (1110). The method 1100 then determines whether the minimal gap situation 200 of FIG. 2 is occurring, or whether the out-of-media sheets situation 800 of FIG. 8 is occurring. This is accomplished by determining whether the level of the signal 301 decreases back to the one media sheet value 308 (1112), and whether the length of time since the level of the signal 301 increased to the maximum value 306—in 1106—is greater than a threshold (1114).

If the length of time since the level of the sensor signal 301 increased to the maximum value 306 is greater than the threshold (1114), then the out-of-media sheets situation 800 of FIG. 8 has occurred (1116). That is, referring back to FIG. 9, the length of time 916 after occurrence of the point 912 has been reached, such that the controller 106 concludes that the media sheet 112B is not being properly advanced, or that the supply of media within the image-forming device of which the optical sensor assembly 100 is a part has been exhausted. If this occurs, then the method 1100 is finished at 1116.

However, if the level of the sensor signal 301 decreases back to the one media sheet value 308 (1112) before the threshold is reached, then the method 1100 is substantially repeated for the next media sheet (1118), which in this case is the media sheet 112B. This is because the minimal gap situation 200 of FIG. 2 has occurred. The leading edge 116B of the media sheet 112B passes between the light source 102 and the transmissive optical sensor 104 (1104), in correspondence with the level of the signal 301 decreasing back to the one media sheet value 308. The method 1100 then performs 1106, et seq., as has been described, in relation to the media sheet 112B and a third media sheet, if any.

If for the first media sheet 112A, however, the level of the sensor signal 301 decreased in 1106 to the overlap value 502, then the method 1100, after performing 1108, concludes or detects that the leading edge of the next media sheet 112B has passed between the light sensor 102 and the transmissive optical sensor 104 (1120). That is, the media sheets 112A and 112B are overlapping, such that the lagging edge 118A of the media sheet 112A is overlapping the leading edge 116B of the media sheet 112B. The overlap value 502 corresponds to the level of the transmitted light 110 in which there is more than one media sheet between the light source 102 and the optical sensor 104. The method 1100 then determines whether the minimal overlap situation 400 of FIG. 4 is occurring, or whether the multiple-media sheet pick-up situation 600 of FIG. 6 is occurring.

This is accomplished by first waiting for the level of the sensor signal 301 to increase back to the one media sheet value 308 (1122). This corresponds to detecting that the lagging edge 118A of the media sheet 112A has passed between the light source 102 and the transmissive optical sensor 104 (1124), but where the media sheet 112B is still between the light source 102 and the optical sensor 104. If the length of time for the level of the sensor signal 301 to increase back to the one media sheet value 308 is not less than a threshold (1126), then the multiple-media sheet pick-up situation 600 of FIG. 6 has occurred (1128). That is, referring back to FIG. 7, the length of time 712 is greater than the threshold, such that the controller 106 concludes that the media sheet 112B has been picked up improperly. If this occurs, then the method 1100 is finished at 1128.

However, if the length of time for the level of the sensor signal 301 to increase back to the one media sheet value 308 is less than the threshold (1126), then the method 1100 is substantially repeated for the next media sheet (1130), which in this case is the media sheet 112B, the leading edge 116B of which has already been detected in 1120. This is because the minimal overlap situation 400 of FIG. 4 has occurred. The method 1100 waits for the level of the signal 301 to change in 1106, and then performs 1108, et seq., as has been described, in relation to the media sheet 112B and a third media sheet, if any.

It is noted that the threshold employed in 1126 is not the same as that employed in 114. Furthermore, it is noted that the method 1100, as well as method 1000 of FIG. 10, are performed in conjunction with an image-formation job for forming images on the media sheets 112. Thus, once the image-forming job has been completed, the methods 1000 and 1100 implicitly end, except that the last media sheet may be advanced completely through the image-forming device, such that the lagging edge of the last media sheet of the image-forming job may be detected.

Image-Forming Device and Conclusion

Figure 12:
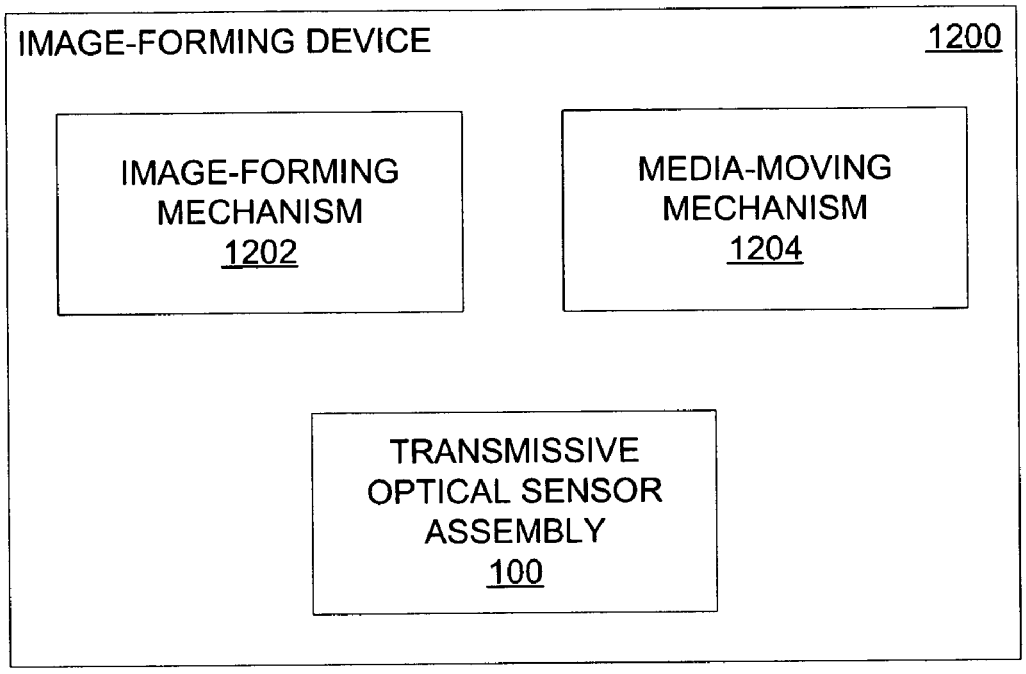
FIG. 12 is a block diagram of an image-forming device having a transmissive optical sensor assembly, according to an embodiment of the invention.

FIG. 12 shows a block diagram of a representative image-forming device 1200, according to an embodiment of the invention. The image-forming device 1200 is depicted in FIG. 12 as including an image-forming mechanism 1202, a media-moving mechanism 1204, and the transmissive optical sensor assembly 100. The image-forming device 1200 may also include other components, in addition to and/or in lieu of those shown in FIG. 12.

The image-forming mechanism 1202 includes those components that allow the image-forming device 1200 to form an image on the media 110. For instance, the image-forming mechanism 1202 may be an inkjet-printing mechanism, such that the image-forming device 1200 is an inkjet-printing device. The mechanism 1202 may also be a laser-printing mechanism or another type of image-forming mechanism, such that the image-forming device 1200 is a laser-printing device or another type of image-forming device. Furthermore, the media-moving mechanism 1204 includes those components that allow the media 110 to move through the image-forming device 1200, so that an image may be formed thereon. The media-moving mechanism 1204 may include rollers, motors, and other types of components.

The transmissive optical sensor assembly 100 can in one embodiment be the transmissive optical sensor assembly 100 that has been described in previous sections of the detailed description. For instance, the optical sensor assembly 100 may be able to determine the location of the leading edge of a media sheet based on changes in light transmitted through the media sheet, as the sheet is advanced through the image-forming mechanism. The sensor assembly 100 may also be able to detect out-of-media sheets and/or multiple-media sheet pick-up situations based on changes in the transmitted light.

It is noted that, although specific embodiments have been illustrated and described herein, it will be appreciated by those of ordinary skill in the art that any arrangement calculated to achieve the same purpose may be substituted for the specific embodiments shown. This application is intended to cover any adaptations or variations of the disclosed embodiments of the present invention. Therefore, it is manifestly intended that this invention be limited only by the claims and equivalents thereof.

We claim:

1. A method comprising:

advancing media sheets through an image-forming device such that each of a plurality of successive pairs of the media sheets are advanced at least substantially adjacent to one another;

transmissively optically sensing a leading edge of each of the media sheets and a lagging edge of each of the media sheets; and, detecting occurrence of an out-of-media sheets situation where a length of time after the lagging edge of one of the media sheets has been optically sensed exceeds a threshold length of time.

2. The method of claim 1, wherein advancing the media sheets through the image-forming device comprises, for each successive pair of the media sheets:

advancing a first media sheet through the image-forming device; and, advancing a next media sheet through the image-forming device such that a leading edge of the next media sheet is advanced at least substantially adjacent to a lagging edge of the first media sheet.

3. The method of claim 2, wherein advancing the next media sheet through the image-forming device comprises advancing the next media sheet through the image-forming device such that the leading edge of the next media sheet minimally overlaps the lagging edge of the first media sheet by less than a threshold.

4. The method of claim 2, wherein advancing the next media sheet through the image-forming device comprises advancing the next media sheet through the image-forming device such that a gap between the leading edge of the next media sheet and the lagging edge of the first media sheet is minimized.

5. The method of claim 1, wherein advancing the media sheets through the image-forming device such that each pair of the plurality of successive pairs of the media sheets are advanced at least substantially adjacent to one another maximizes speed of advancement of the media sheets through the image-forming device.

6. The method of claim 1, wherein transmissively optically sensing the leading edge of each of the media sheets comprises:

emitting light incident to a first side of the media sheets being advanced;

detecting the light transmitted through the media sheets being advanced from a second side of the media sheets opposite to the first side thereof; and, in response to determining that a level of the light changes from a first value to a second value different than the first value and then back to the first value, concluding that the leading edge of one of the media sheets has been located.

7. The method of claim 1, wherein detecting occurrence of the out-of-media sheets situation comprises:

emitting light incident to a first side of the media sheets being advanced;

detecting the light transmitted through the media sheets being advanced from a second side of the media sheets opposite to the first side thereof; and, in response to determining that a level of the light remains at a second value for longer than the threshold length of time after having changed from a first value less than the second value, concluding that the out-of-media sheets situation is occurring.

8. The method of claim 1, further comprising transmissively optically sensing a multiple-media sheet pick-up situation occurring.

9. The method of claim 8, wherein transmissively optically sensing the multiple-media sheet pick-up situation occurring comprises:

emitting light incident to a first side of the media sheets being advanced;

detecting the light transmitted through the media sheets being advanced from a second side of the media sheets opposite to the first side thereof; and, in response to determining that a level of the light remains at a second value for longer than a threshold length of time after having changed from a first value greater than the second value, concluding that the multiple-media sheet pick-up situation has occurred.

10. The method of claim 8, wherein transmissively optically sensing the multiple-media sheet pick-up situation occurring comprises:

emitting light incident to a first side of the media sheets being advanced;

detecting the light transmitted through the media sheets being advanced from a second side of the media sheets opposite to the first side thereof;

determining a length of time threshold at which a level of the light remains at a first value after having changed from a second value greater than the first value and before changing to one of the second value and a third value less than the first value; and, in response to determining that the level of the light thereafter remains at the first value for a length of time substantially shorter than the length of time threshold, concluding that the multiple-media sheet pick-up situation has occurred.

11. A sensor assembly for an image-forming device comprising:

a light source to emit light through media sheets as the media sheets are advanced through the image-forming device, each pair of a plurality of successive pairs of the media sheets being advanced through the device such that a leading edge of a second media sheet of the pair closely follows a lagging edge of a first media sheet of the pair;

a transmissive optical sensor to detect the light emitted through the media sheets as the media sheets are advanced through the image-forming device; and, a controller to determine occurrence of an out-of-media sheets situation where a length of time after the lagging edge of the first media sheet of one pair of the plurality of successive pairs of the media sheets has been detected, based on changes in the light as detected by the transmissive optical sensor, exceeds a threshold length of time.

12. The sensor assembly of claim 11, wherein the controller is further to determine a location of the leading edge of the second media sheet of each pair of the plurality of successive pairs of the media sheets based on changes in the light as detected by the transmissive optical sensor.

13. The sensor assembly of claim 12, wherein the controller determines the location of the leading edge of the second media sheet of each pair of the plurality of successive pairs of the media sheets by determining that a level of the light increases from a first value to a second value and then decreases back to the first level, corresponding to a small gap between the lagging edge of the first media sheet and the leading edge of the second media sheet.

14. The sensor assembly of claim 13, wherein the controller further determines a location of the lagging edge of the first media sheet of each pair of the plurality of successive pairs of the media sheets when determining that the level of the light increases from the first value to the second value, such that a length of the first media sheet is determined.

15. The sensor assembly of claim 12, wherein the controller determines the location of the leading edge of the second media sheet of each pair of the plurality of successive pairs of the media sheets by determining that a level of the light decreases from a first level to a second level and then increases back to the first value, corresponding to a slight overlap between the lagging edge of the first media sheet and the leading edge of the second media sheet.

16. The sensor assembly of claim 15, wherein the controller further determines a location of the lagging edge of the first media sheet of each pair of the plurality of successive pairs of the media sheets when determining that the level of the light increases back to from the second value to the first value, such that a length of the first media sheet is determined.

17. An image-forming device comprising:

an image-forming mechanism to form images onto media sheets;

a media-advancement mechanism to advance the media sheets through the image-forming mechanism for image formation thereon, such that for each pair of a plurality of successive pairs of the media sheets, a leading edge of a second media sheet of the pair closely follows a lagging edge of a first media sheet of the pair; and, a transmissive optical sensor assembly to determine a location of the leading edge of the second media sheet and a location of the lagging edge of the first media sheet of each pair of the plurality of successive pairs of the media sheets, based on changes in light transmitted through the media sheets as the media sheets are advanced through the image-forming mechanism, and to detect an out-of-media sheets situation occurring, and to detect a multiple-media sheet pick-up situation occurring where a length of time after the lagging edge of one of the media sheets has been optically sensed exceeds a threshold length of time.

18. The image-forming device of claim 17, wherein the image-forming mechanism is an inkjet-printing mechanism, such that the image-forming device is an inkjet-printing device.

19. The image-forming device of claim 17, wherein the transmissive optical sensor assembly comprises:

a light source to emit light through the media sheets as the media sheets are advanced through the image-forming mechanism for image formation thereon; and, a transmissive optical sensor to detect the light emitted through the media sheets as the media sheets are advanced through the image-forming mechanism for image formation thereon.

20. An image-forming device comprising:

an image-forming mechanism to form images onto media sheets;

a media-advancement mechanism to advance the media sheets through the image-forming mechanism for image formation thereon, such that for each pair of a plurality of successive pairs of the media sheets, a leading edge of a second media sheet of the pair closely follows a lagging edge of a first media sheet of the pair; and, means for determining a location of the leading edge of the second media sheet and a location of the lagging edge of the first media sheet of each pair of the plurality of successive pairs of the media sheets, based on changes in light transmitted through the media sheets as the media sheets are advanced through the image-forming mechanism, and for detecting an out-of-media sheets situation occurring where a length of time after the lagging edge of one of the media sheets has been detected exceeds a threshold length of time.

* * * * *